US005867853A

United States Patent [19]

Feld

[11] Patent Number: 5,867,853

[45] Date of Patent: Feb. 9, 1999

[54] SAFETY DEVICE FOR STEEL BED RAIL

[76] Inventor: Mark Feld, 6105 Benhurst Rd., Baltimore, Md. 21209

[21] Appl. No.: 839,396

[22] Filed: Apr. 11, 1997

[51] Int. Cl.[6] ..... A47C 21/00

[52] U.S. Cl. ..... 5/663; 5/424

[58] Field of Search ..... 5/663, 424, 200.1; 248/345.1

[56] References Cited

U.S. PATENT DOCUMENTS

| | | | |
|---|---|---|---|
| 2,951,252 | 9/1960 | Roche | 248/345.1 |
| 3,546,725 | 12/1970 | Tambascio | 5/663 |
| 4,109,887 | 8/1978 | Wakeland, Jr. | 5/663 |
| 4,514,871 | 5/1985 | Fisher et al. | 5/663 |
| 4,710,992 | 12/1987 | Falwell et al. | 5/663 |
| 5,331,696 | 7/1994 | Armstrong et al. | 5/663 |

*Primary Examiner*—Alex Grosz
*Attorney, Agent, or Firm*—Peter Gibson

[57] ABSTRACT

A length of impact absorption material has a configuration including a channel closed at the top and open at the bottom of substantially uniform width of less than one eighth of an inch. The portion of the configuration above and exteriorly adjacent to the top end of the channel is at least a quarter of an inch thick. An interior portion and an exterior portion of the configuration are laterally opposed to each other upon either side of the channel. A length of absorption material possessing this configuration is positioned upon the vertical leg of an L-shaped steel rail of a metal bed frame, which is approximately one tenth of an inch thick, such that the top edge of the rail meets the closed top end of the channel. The top portion and uppermost portion of the exterior portion of the length of absorption material provide cushioning for the top edge of the rail. The exterior portion may extend downward a distance sufficient to cover the outward face of the rail and may also extend at the lower end of the same inward beneath the bottom exterior corner of the rail in order to fully cushion the exposed part of the rail in a bed frame and to better secure the length of absorption material to the rail. Elastomeric material is recommended as is a thickness of the top portion and the uppermost part of the exterior portion of at least three eighths of an inch.

12 Claims, 3 Drawing Sheets

FIG 3
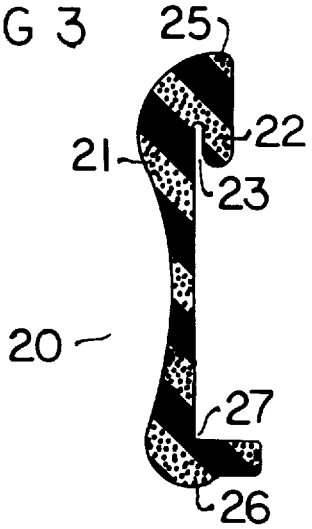
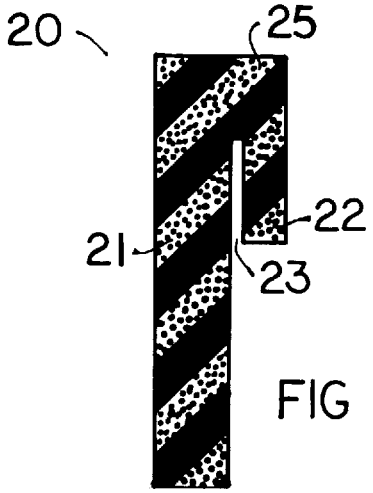
FIG 4
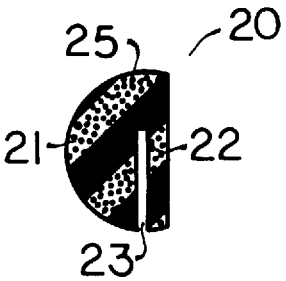
FIG 5
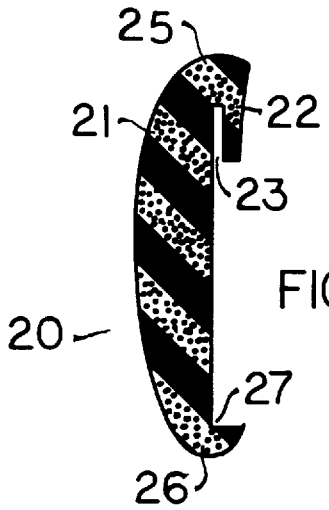
FIG 6

SAFETY DEVICE FOR STEEL BED RAIL

BACKGROUND OF THE INVENTION

1. Field of the Invention

The field of the present invention relates generally to attachments or accessories to beds, more particularly to attachments adapted to cover or protect a rail or frame portion of a bed and most specifically such attachments adapted to provide a cushion for an L-shaped steel rail comprising a portion of a bed frame.

2. General Background

Historically bed frames are considered generally to have been made from wood. The utilization of steel in bed construction was perhaps first known and widely practiced in the manufacture of springs in a box frame which is commonly known as box springs. Head and foot boards, as the terms connote, were and still preferably are, made from wood. Neither box springs nor head nor foot boards, however, are considered to comprise components of a typical, modern, bed frame. Box springs are considered to be separate from a bed frame though typically disposed directly upon the frame, and both head and foot boards, though historically a part of a wooden bed frame, are unnecessary to a steel bed frame which typically lacks both. Brass bed frames, though quite popular earlier in this century, are considered fairly uncommon today and bed frame construction currently is considered to be predominantly in steel despite this practice being relatively recent.

Modern bed frames of steel construction are further considered typified by the use of a pair of L-shaped steel side rails attached proximate either end to a perpendicularly disposed L-shaped steel end rail to which a pair of feet are attached. While both pairs of steel rails are typically constructed from an extruded L-shaped length of steel possessing a corner from which two legs extend perpendicularly, each leg having a longitudinal free edge diagonally parallel to the other, the side rails are invariably oriented upward and the end rails typically oriented downward. Upward and downward in this case is understood to connote the direction of a vertical leg in relation to the corner of the rail with the other leg disposed horizontally.

The side rails are further considered to be necessarily oriented upward in a modern bed frame of typical construction in order to provide, at the minimum of expense in construction, lateral positioning of the box spring disposed therebetween thus ensuring that the box spring remains immobile with respect to the bed frame. The box springs rest upon the upper surface of the horizontal, inward oriented, legs of the side rails and the end rails are attached to the lower surface of the same. The end rails necessarily are oriented downward in this construction with the upper surface of the horizontal legs flush with the lower surface of the horizontal legs of the side rails. The legs, furthermore, are typically attached to the vertical legs of the end rails which, for this reason also, must be oriented downward. This arrangement is considered to be the most economic and the most common construction of bed frames known at present.

It is also noted that, historically, beds commonly possessed greater height than that which is common today. Heat was relatively more expensive in centuries past and sleeping closer to the floor, where it was colder, was undesirable. Today residential ceilings are commonly only nine feet high or less whereas a century ago ceilings were commonly twelve feet high or more. With relatively lower energy costs and newer technology such as central heating and air conditioning, it is more economic to build residential structures with relatively low ceilings and to build beds which are lower to the ground than the equivalent historical structures. A bed construction which is lower to the ground than another construction is more economic to manufacture than the other. Less material is required of the structure of lesser height, obviously, and the structure itself may be made of lighter gauge material since a lower structure of the same gauge material is inherently more stable than the higher structure.

DISCUSSION OF THE PRIOR ART

Historically bed frames have been constructed in wood and this is inclusive of cribs for infants. In order to prevent injury from teething infants to the rail, U.S. Pat. No. 2,564,386 issued to Webb and U.S. Pat. No. 2,636,189 issued to Feldman both disclose a plastic covering for the top of a wooden rail each quite similarly comprised of an extruded configuration possessing a barbed protrusion extending inwardly from the device inserted into a longitudinal groove in the wooden rail. Webb discloses use of two opposed lateral barbed protrusions and Feldman discloses use of a single central barbed protrusion extending downward together with lateral legs resiliently exerting pressure inward upon the rail.

Waterbed frames are still, invariably, constructed in wood. This is considered to be essentially necessary as the most economic construction viable for a mattress comprised of a fluid reservoir held within a fluid impermeable flexible bladder. It is considered that the frame for such a mattress must necessarily possess an elevation equal to the uppermost height of the mattress under a loaded condition and therefore an elevation substantially superior to the mattress in an unloaded condition. The upper exterior edge of the side rails of the frame, which invariably consist of either two by ten inch or two by eight inch lengths of lumber, are hence necessarily exposed. Because of the enormous weight involved waterbeds are also invariably rather low to the floor in comparison with most other types of beds. For both of these reasons, the upper exterior edges of waterbed frames are commonly hit by one's shins and many disclosures are known which are concerned with this problem.

U.S. Pat. No. 4,109,887 issued to Wakeland for a 'Waterbed Retainer Cap' is an example. Waterbeds commonly use a liner which is attached interiorly to the bed frame and this provides the primary concern typical to these disclosures. Use of foam cushioning in conjunction with a structure which will readily attach to the upper edge of a two inch nominal, one and seven-eighths inch actual, thick lengths of lumber and which will also secure a liner to this frame are typical characteristics of these disclosures.

With regard to metal bed frames, however, only two pertinent references are known which describe attachments to L-shaped rails. U.S. Pat. No. 2,951,252 issued to Roché for a 'Bedframe Side Rail End Cap' discloses a thin walled plastic cover for the end of an L-shaped steel rail of the type typically utilized in bed frame construction which was intended to prevent one from snagging clothing or otherwise incurring damage to clothing from contact with the then exposed and commonly sawed off ends of the steel rail of a bed frame.

Another device, though unconcerned with safety, utilized specifically in association with an L-shaped steel side rail of a bed, is disclosed by U.S. Pat. No. 3,546,725 issued to Tambascio for a 'Bedframe with Decorative Trim Strip' which provides for concealment of the outer face of the rail with a device which clips upon the upward member of the rail and which depends downward therefrom, covering the entire outward face of the rail for aesthetic purposes only.

Statement of Need

The increasingly common construction of beds utilizing a pair of L-shaped steel rails as described above, in conjunction with construction of beds which are relatively low in comparison with historical norms, is considered in combination to present a significant safety hazard which has been wholly overlooked. Because each steel rail is relatively thin, approximately one tenth of an inch (typically .109") in thickness, and because the top edge of each side rail is typically disposed at an elevation within a few feet of the floor, it is a commonplace for children to injure themselves in an accidental collision with a steel bed side rail, particularly the top edge of the same.

The National Injury Information Clearinghouse, a division of the U.S. Consumer Product Safety Commission (CPSC), has collected thousands of reports of injury related to metal bed frames. These statistics have been compiled from accident investigation reports, consumer complaints, death certificates and the National Electronic Injury Surveillance System (NEISS).

From this information it is seen that injuries resulting from accidental collision with metal bed frames most commonly involve the legs and head and that these injuries range in severity from lacerations and contusions to dislocations and fractures. Extrapolation of these NEISS data in the 'Product Summary Report', U.S. CPSC, 1995, yields an estimation of the total number of injuries related to metal bed frames and bed springs as exceeding 50,000 annually in the United States.

Because of the number and severity of injuries resulting from accidental collision with a metal bed frame, particularly the upward facing member or leg of a steel rail of a bed frame, there is considered to exist a need for a safety device specifically adapted to and readily deployed upon such a rail of an existing bed frame which will lessen the incidence and severity of these injuries.

SUMMARY OF THE INVENTION

Objects of the Invention

The encompassing object of the present invention is the provision of a device which will effect a reduction in the incidence and severity of injury resulting from accidental collision with an L-shaped steel rail of a bed frame.

The primary object of the present invention is the provision of a device which will effect a reduction in the incidence and severity of injury resulting from accidental collision with the vertical leg of an L-shaped steel rail of a bed frame.

A first auxiliary object of the present invention is the provision of a device which will effect a reduction in the incidence and severity of injury resulting from accidental collision with the upper edge of the vertical leg of an L-shaped steel bed side rail.

A secondary auxiliary object of the present invention is the provision of a device which will effect a reduction in the incidence and severity of injury resulting from accidental collision with the outward face of an L-shaped steel rail of a bed frame.

A third auxiliary object of the present invention is the provision of a device which will effect a reduction in the incidence and severity of injury resulting from accidental collision with the exterior corner of an L-shaped steel rail of a bed frame.

An ancillary object of the present invention is the provision of a device which will effect a reduction in the incidence and severity of injury resulting from accidental collision with an L-shaped steel rail of a bed frame which is easily attached to a standing bed.

Another ancillary object of the present invention is the provision of a device which will effect a reduction in the incidence and severity of injury resulting from accidental collision with an L-shaped steel rail which is easily attached to but not easily removed from a standing bed.

Other ancillary objects of the present invention include the provision of a device which will effect a reduction in the incidence and severity of injury resulting from accidental collision with an L-shaped steel rail which is economic, which is non-toxic, and which is otherwise safe to children and others.

Principles Relating to the Present Invention

It is first recognized that the present invention is concerned primarily with safety. While it is generally a benefit to present an aesthetically pleasing appearance a structure in accordance with the principles relating to the present invention must effectively reduce the incidence and severity of injury resulting from collision with an L-shaped steel rail of a bed frame. Hence a cushion which may readily be disposed upon an L-shaped steel rail is suggested. Such a cushion must possess satisfactory physical characteristics with regard to the absorption of impact and also with respect to disposition upon the L-shaped rail. These two necessary physical requirements together provide the basis for the principles relating to the present invention.

A typical L-shaped steel rail of a bed frame, as mentioned earlier, possesses two legs extending perpendicularly from a common corner which each present a free longitudinal edge substantially parallel to and spaced diagonally apart from each other. Furthermore, current construction of metal frame beds utilizes a pair of L-shaped steel side rails disposed substantially parallel to and spaced apart from each other with each said side rail oriented such that one leg is horizontal with a free edge directed inward and the other leg is vertical with a free edge, known hereinafter as the top edge of the rail, directed upward. The exterior corner of the rail thus comprises a bottom edge of the exterior, exposed, portion of this side rail which comprises a substantially smooth, flat, vertical face between the side rail top and bottom edges.

As set forth in the objects of the present invention, it is considered desirable to cushion the entire exposed structure of an L-shaped steel rail of a bed frame. This exposed area includes the top and bottom edges of either side rail and the outward facing substantially vertical surface therebetween. The top edge is considered the most important portion with regard to the need for sufficient cushioning for two reasons. It is considered the most likely portion of the rail with which to collide in a fall, for one. Secondly, it is considered the most potentially injurious portion of the rail in a collision because it presents the sharpest contact area. As mentioned earlier, the thickness of a leg of a typical L-shaped steel rail of a bed frame is approximately one tenth of an inch (.109"). And the free edge of one of the legs possesses an effective width which varies but which is generally less than the thickness of the leg.

In order to provide adequate cushioning of the top edge of an L-shaped steel bed side rail an elastomeric material of good impact absorption characteristics is recommended. The most salient aspect of construction is sufficient thickness of the material used, both exteriorly adjacent to and above the top edge of the rail. Relative to the thickness of each leg of a typical steel rail of a bed frame the thickness of the cushion provided both above and exteriorly adjacent this top edge must be over twice the thickness of the rail leg, or at least a quarter of an inch, and preferably three-eighths of an inch or more. A commensurate though lesser degree of cushioning is desired for the bottom edge of a side rail and for the exterior face of the rail.

With regard to satisfactory attachment of a safety device in accordance with the principles relating to the present invention to a typical L-shaped steel bed side rail it is considered that, because of the degree of cushioning required above the top edge of the rail, location upon this top edge is necessary and a channel, i.e. a longitudinal open interior cavity of uniform dimensions, possessing a width and depth appropriate to the width and height of the vertical leg of a typical L-shaped steel rail of a bed frame, is further required for proper location of what is considered the most critical cushioning structure of the device. While adhesive may further be used to fix the disposition of the device to the rail proper positioning of the device demands a channel into which the free edge of the vertical leg of the rail fits and with which proper location of the device with respect to this free edge may be readily effected.

Variations and other aspects of the preferred embodiments of the principles relating to the present invention will be readily appreciated with a reading of the detailed description following particularly if conducted with reference to the drawings attached hereto.

BRIEF DESCRIPTION OF THE DRAWINGS

FIG. 3 is a cross sectional view of a third preferred embodiment of the principles relating to the present invention.

FIG. 4 is a cross sectional view of a fourth preferred embodiment of the principles relating to the present invention.

FIG. 5 is a cross sectional view of a fifth preferred embodiment of the principles relating to the present invention.

FIG. 6 is a cross sectional view of a sixth preferred embodiment of the principles relating to the present invention.

DETAILED DESCRIPTION OF THE PREFERRED EMBODIMENTS

Figure 1A:
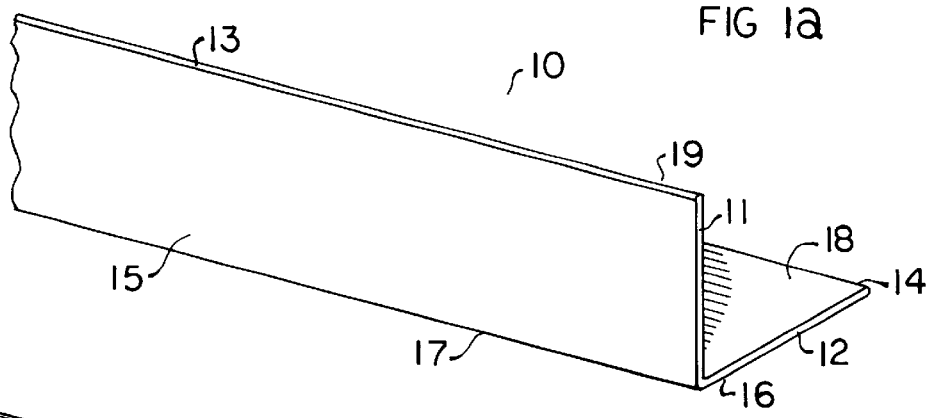
FIG. 1*a* is an isometric partial view of an L-shaped steel rail of the type and orientation typical use as a side rail of a modern steel bed frame.

FIG. 1*a* depicts a portion of an L-shaped steel rail 10 oriented such that one vertical leg 11 and one horizontal leg 12 are readily recognized. As described earlier, this is the disposition invariably utilized for the side rails of a modern bed frame of metal construction. The vertical leg 11 has a longitudinal free edge directed upward known herein as the top edge 13. The horizontal leg 12 has a free edge directed inward known hereinafter as the lateral edge 14. The exterior face of the vertical leg 11 is oriented outward from the bed and is known hereinafter as the outward face 15. Similarly, the exterior face of the horizontal leg 12 is oriented downward and is known hereinafter as the bottom face 16. Between the outward face 15 and the bottom face 16 is a longitudinal edge or corner known hereinafter as the exterior corner 17. The upper face of the horizontal leg, upon which a box spring typically rests, is known hereinafter as the upper face 18 and the interior face of the vertical leg 11 is known hereinafter as the inward face 19.

Figure 1B:
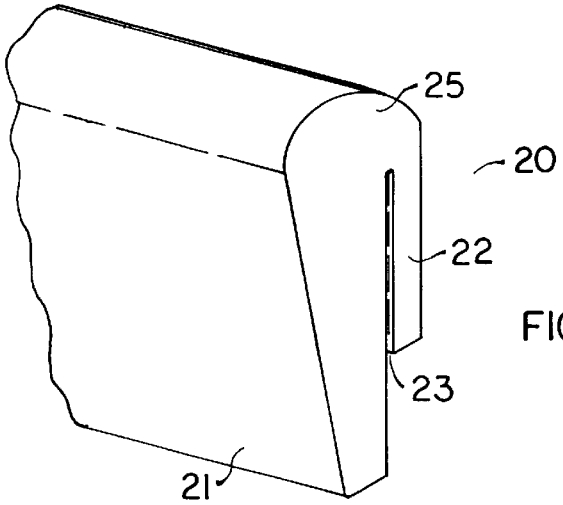
FIG. 1*b* is an isometric partial view of a first preferred embodiment in accordance with the principles relating to the present invention.

FIG. 1*b* depicts a portion of a length of an extrusion, preferably in an elastomeric material which possesses good impact absorption characteristics, which represents a first preferred embodiment of the principles relating to the present invention. This length of extrusion is intended to be disposed upon the vertical leg 11 of an L-shaped rail 10 comprising a portion of a modern metal bed frame such as that depicted in FIG. 1*a*. This disposition is depicted in FIG. *c*. This length of extrusion, because it is specifically intended to provide this cushioning, is considered a safety device 20. This safety device 20 is characterized by possession of an exterior portion 21 and an interior portion 22 separated by a channel 23 therebetween open at the bottom and dimensioned to provide positioning of the safety device 20 upon the vertical leg 11 of an L-shaped rail 10 utilized as a portion of a frame for a bed. This safety device 20 is further characterized by a substantial portion above the channel 23 known hereinafter as the top portion 25. All of these characteristics are considered necessary to fulfillment of the principles relating to the present invention.

Figure 1C:
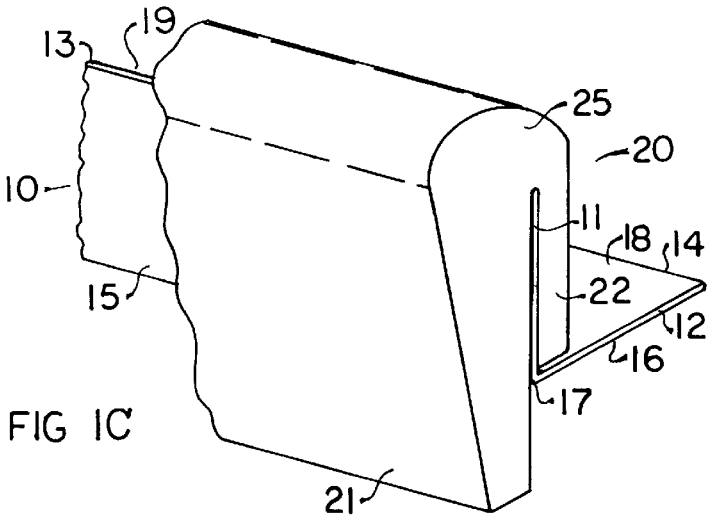
FIG. 1*c* is an isometric view of the device depicted in FIG. 1*b* located upon the rail of FIG. 1*a*.

As further seen in FIG. 1*b*, the exterior portion 21 extends downward a distance from the top portion 25 further than the interior portion 22. As seen in FIG. 1*c* the interior portion 22 extends in position upon the vertical leg 11 of an L-shaped steel rail 10 along the inward face 19 almost to the upper face 18 and the exterior portion 21 extends downward along the outward face 15 past the exterior corner 17. This configuration, which is not necessary to fulfillment of the principles relating to the present invention, is utilized for two reasons. First, it is desired to provide cushioning of the entire outward face 15 including the exterior corner 17. Secondly, it is desired to provide a secure mounting of the safety device 20 upon the vertical leg 11 without additional means such as adhesive. Adhesive may always be applied to the vertical leg 11 prior to location of the safety device 20 upon the same but it is considered economically prohibitive generally and wholly impractical in the configuration depicted in FIGS. 1*b* & 1*c* to provide adhesive upon the interior walls of the channel 23.

For this latter reason the interior portion 22 extends as far downward along the inward face 19 as is permissible. Also for this reason the channel 23 is preferably of a substantially uniform width and is necessarily commensurate with the width of the vertical leg 11 such that contact is made by the exterior portion 21 with the outward face 15 and by the interior portion 22 with the inward face 19. In order to provide superior gripping characteristics, it is further recommended that the width of the channel 23 be slightly less than the width of the vertical leg 11. This is readily accomplished as the width of the vertical leg 11 is substantially invariant in L-shaped steel rails 10 utilized in current construction of modern bed frames. In actual physical dimensions this width is about one tenth of an inch (typically .109"). It is recommended, therefore, that the width of the channel 23 be at least one but not more than three thirty-secondths of an inch (.031–.094") and it is considered that the width of the channel 23 must be less than an eighth of an inch (.125") in order to function properly.

Another aspect concerned with actual physical dimensions of the L-shaped steel rails 10 utilized in current construction of metal bed frames is of considerable importance to the present invention and provides a third reason for the configuration of the safety device 20 depicted in FIGS. 1*b* & 1*c*. L-shaped steel rails 10 utilized in current construction of metal bed frames, while having a standard width as mentioned above, possess one of three different heights with regard to the vertical leg 11. One standard height is one and one quarter inches (1.25"), another is one and one half inches (1.50") and the third is two inches (2.00"). The length of the exterior portion 21, which is taken as the distance from the top of the channel 23 to the bottom of the exterior portion 21, may be suited to each standard size and hence preferably exceed slightly one and one quarter inches, one and one half inches, or two inches in length.

It is considered, as a practical matter in manufacture and marketing of a safety device 20 in accordance with the principles relating to the present invention, that it is desirable to make and sell one configuration which may be readily applied to all standard heights. The configuration depicted in FIGS. 1*b* & 1*c* has an interior portion 22 which is dimensioned in length along the channel 23 to make full use of the one and one quarter inch vertical leg 11 height while fitting the larger heights as well while the exterior portion 21 extends well below the exterior corner 17 of the smaller standard vertical leg 11 height depicted and is dimensioned to reach the exterior corner 17 of the largest vertical leg 11 size so that the outward face 15 of the vertical leg 11 is cushioned in any case.

While it is considered important to ensure that the entire outward face 15 is so cushioned, it is vital to the principles relating to the present invention that the top edge 13 be sufficiently cushioned by the safety device 20 in accordance with those principles. As mentioned earlier, the top edge 13 is no thicker than the width of the vertical leg 11 and, in order to provide adequate cushioning of this top edge 13 it is considered necessary to provide the top portion 25 and the uppermost part of the exterior portion 21 with a thickness which is more than thrice the width of the vertical leg 11, i.e. at least three-eighths of an inch (.375") or greater.

It is recognized, however, that the effective cushioning obtained is dependent not only on the thickness but also the specific material utilized. Relatively high density material will require less thickness than a lower density material even though the chemical composition of that material might be the same. Elastomeric material is recommended so that the safety device 20 will regain its shape after impact and so that, if the channel 23 is of a lesser width than the vertical leg 11, as is also recommended, a grip upon the same will obtained.

Figure 2A:
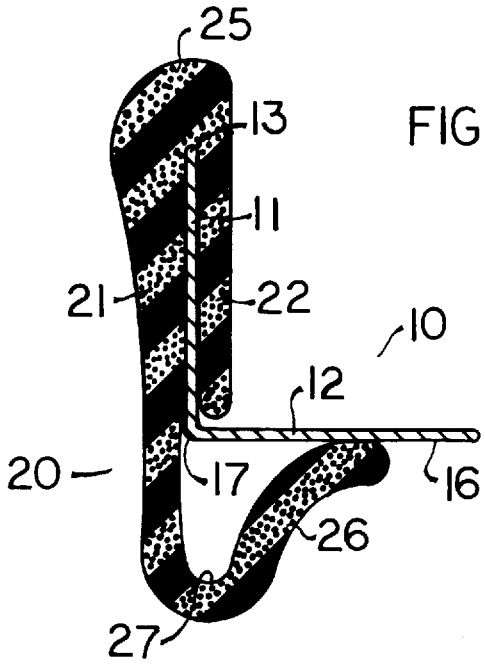
FIG. 2*a* is a cross sectional view of a second preferred embodiment in accordance with the principles relating to the present invention located upon a short L-shaped steel rail of the type and orientation typical of use as a side rail of a modern steel bed frame.
Figure 2B:
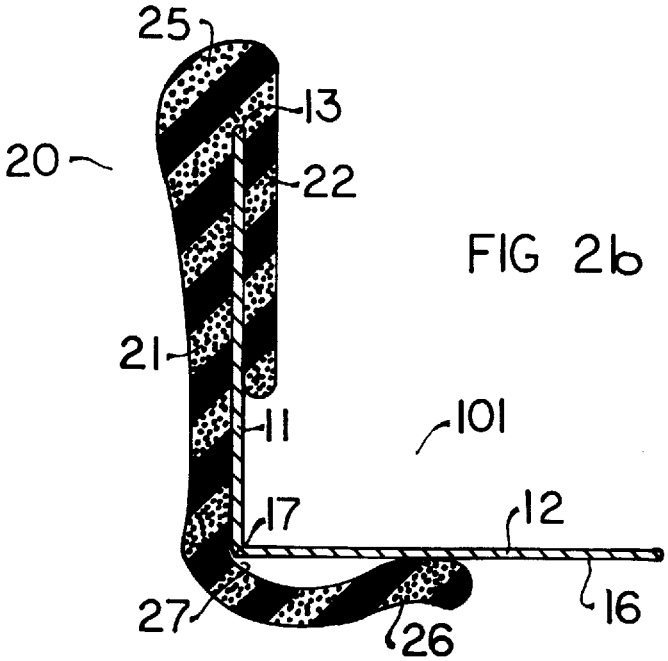
FIG. 2*b* is a cross sectional view of the safety device depicted in FIG. 2*a* located upon a tall L-shaped steel rail of the type and orientation typical of use as a side rail of a modern steel bed frame.

The exterior corner 17 is also of concern. The safety device 20 depicted in FIGS. 1*b* & 1*c* is configured to extend well below this exterior corner 17 on a short vertical leg 11 and at least reach the vertical corner 17 of the largest vertical leg 101, in order to provide cushioning of this corner 17 from the most likely angles of impact. In order to provide cushioning of the exterior corner 17 from impact from below the rail, it is considered necessary that the configuration of the safety device 20 possess a bottom portion 26 as seen in FIGS. 2*a* & 2*b* which extends inwardly below this exterior corner 17. This bottom portion 26 also preferably provides, in conjunction with the channel 23, better gripping of the rail 10, 101. In order to accommodate the several different sizes of L-shaped steel rails 10, 101 commonly utilized it is recommended that the configuration of the safety device 20 include an interior corner 27 which, as clearly seen in FIG. 2*a,* is acute and which causes the bottom portion 26 to contact the bottom face 16 of the horizontal leg 12 of the smallest L-shaped steel rail 10.

As seen in FIG. 2*b,* it is further desired, in order to accommodate the largest size L-shaped steel rail 101 depicted therein, that this interior corner 27 be located at a distance from the top of the channel 23 sufficient to allow the bottom portion 26 to extend perpendicularly from the exterior portion 21 when the device 20 is disposed upon the largest L-shaped steel rail 101. The interior corner 27 as depicted in FIG. 2*b* is perpendicular. This corner 27 may also be acute when disposed upon the largest rail 101 but if it becomes obtuse the safety device 20 will not grip the largest rail 101 as well as if it is acute or perpendicular.

Of course, a safety device 20 in accordance with the principles relating to the present invention may be made expressly for any size L-shaped steel rail 10, 101 utilized in the construction of a metal bed frame. And, particularly in this case, it is not necessary to have the interior portion 22 or a bottom portion 26 extend as far as depicted in the figures attached hereto discussed above. As clearly seen in FIG. 3, a relatively short interior portion 22 and a rather short bottom portion 26 is utilized. Being formed to a particular size of L-shaped rail 10, 101, the safety device 20 depicted herein will grip satisfactorily despite the relative shortness of these portions 22, 26.

All the embodiments of the principles relating to the present invention depicted in the figures attached herein discussed above possess a generally rounded exterior perimeter, particularly about the top portion 25 which preferably bulges outward as well in order to provide what is considered the best manner of providing an effective cushioning of the top edge 13. This is not, however, necessary to fulfillment of the principles relating to the present invention. As clearly seen in FIG. 4, an entirely rectilinear perimeter to the safety device 20 is considered wholly satisfactory. Obtaining relatively sharp corners in manufacture is generally not considered economic, however, and is not recommended for this reason. Otherwise, because the material is one possessing good impact absorption characteristics, the resulting sharp exterior corners on the device are inconsequential with regard to function.

All of the embodiments of the principles relating to the present invention depicted in the figures attached herein discussed above possess an exterior portion 21 which is of greater length than the interior portion 22. This aspect is also considered unnecessary to fulfillment of the principles relating to the present invention. As clearly seen in FIG. 5, these two portions 21, 22 are of substantially equivalent length. The outward face 15 of the vertical leg 11 is not fully cushioned in this case but as the top edge 13 is considered to comprise the most important and only vital element of an L-shaped steel rail 10, 101 which must be cushioned. Hence the safety device 20 depicted in FIG. 5 is considered to fulfill the principles relating to the present invention in providing a satisfactory cushioning of the top edge 13. This particular embodiment is also considered to be the most economic manufacture feasible and one which is equally satisfactory upon the full range of sizes in L-shaped steel rails 10, 101 utilized currently in the construction of a modern metal bed frame.

Finally attention is directed to FIG. 6. Although the configuration depicted therein is inherently restricted to one size of L-shaped steel rail 10, 101 and provides more cushioning of the outward face 15 relative to the top edge 13, which is generally considered less effective with regard to use of material in achievement of the objectives of the principles relating to the present invention, the safety device 20 depicted herein is considered to possess certain merits. For one, although this is explicitly not a fundamental concern, the safety device 20 depicted in FIG. 6 is considered to provide a generally pleasing aesthetic aspect. Secondly, and more pertinently to fulfillment of the objectives of the principles relating to the present invention, the configuration depicted in FIG. 6 is considered to be more easily achieved in extrusion or molding than certain other configurations such as those depicted in FIGS. 2*a* & 2*b* and FIG. 4, particularly, and also, perhaps, those depicted in FIGS. 1*b* & 1*c*.

The manufacture of any of the configurations depicted in the drawings attached hereto or any variation of the elements discussed above is considered to be well within the ability of one practiced in the art. Because the configuration required is substantially uniform, extrusion is recommended but molding is also considered to be a perfectly satisfactory approach to manufacture. The foregoing is considered exemplary with regard to what is considered instructive to one practiced in the art in obtaining what is considered the best manner of making and utilizing an embodiment in accordance with the principles relating to the present invention and is not to be considered in any manner restrictive of the scope of the subject matter encompassed by the property granted by Letters Patent for which I hereby claim:

I claim:

1. A safety device intended to reduce the incidence and severity of injury resulting from accidental collision with the vertical leg (11) of an L-shaped steel rail (10) of a metal bed frame which possesses a substantially uniform thickness of approximately one tenth of an inch, opposed outward (15) and inward (19) faces, the outward face (15) being bounded by a top edge (13) and a bottom exterior corner (17), said L-shaped steel rail (10) further possessing a horizontal leg (12) possessing a bottom face (16) bounded by said bottom exterior corner (17) and a lateral edge (14), said safety device (20) comprising:

a length of elastic impact absorption material possessing a configuration possessing an exterior portion (21), an interior portion (22), a channel (23) and a top portion (25);

said channel (23) being open at the bottom, closed at the top, and possessing a substantially uniform width between opposed lateral sides of less than one eighth of an inch;

said top portion (25) being superior in elevation to said top closed end of said channel (23);

said exterior portion (21) and said interior, portion (22) of said configuration each being inferior in elevation to said closed top end of said channel (23) and lateral to said channel (23) along opposed sides of said channel (23);

an uppermost part of said exterior portion (21) of said configuration and said top portion (25) of said configuration each possessing a thickness of approximately three eighths of an inch;

said interior portion (22) possessing a width of less than one quarter of an inch;

disposition of said length of elastic impact absorption material upon the vertical leg (11) of an L-shaped steel rail (10) of a metal bed frame such that said closed top end of said channel (23) is disposed in contact with the top edge (13) of said vertical leg (11) and said exterior portion (21) of said configuration is disposed adjacent the outward face (15) of said vertical leg (11) and said interior portion (22) of said configuration is disposed adjacent the inward face (19) of said vertical (11) leg thereby disposes said top portion (25) of said configuration above and said uppermost part of said exterior portion (21) adjacent to the top edge (13) of said vertical leg (11);

whereby said top portion (25) and the uppermost part of said exterior portion (21), having a thickness of at least three eighths of an inch and composed of an elastic impact absorption material, thereby provides cushioning for said top edge (13) of said vertical leg (11) of said L-shaped steel rail (10) of a metal bed frame and a reduction in the severity and incidence of injury resulting from collision with the vertical leg (11) of the L-shaped steel rail (10) of a metal bed frame upon which the safety device (20) is disposed.

2. The safety device (20) of claim 1 wherein said substantially uniform width of said channel (23) is less than one tenth of an inch.

3. The safety device (20) of claim 2 wherein said substantially uniform width of said channel (23) is greater than one thirty-second of an inch.

4. The safety device (20) of claim 1 wherein said exterior portion (21) of said configuration of said length of elastomeric absorption material possesses a length of at least one and one quarter inches.

5. The safety device (20) of claim 4 wherein said exterior portion (21) of said configuration possesses a length of at least one and one half inches.

6. The safety device (20) of claim 4 wherein said exterior portion (21) of said configuration possesses a length of at least two inches.

7. The safety device (20) of claim 1 further possessing a bottom portion (26) extending inward from the lower end of said exterior portion (21) of said configuration which, when said safety device is disposed upon the vertical leg (11) of an L-shaped steel rail (10) of a metal bed frame, may readily be disposed underneath the bottom exterior corner (17) of said rail (10) in extension inward from said bottom exterior corner (17).

8. The safety device (20) of claim 7 wherein said configuration is further particularized by an interior corner (27) formed by the juncture between said bottom portion (26) and said exterior portion (21) of said configuration.

9. The safety device (20) of claim 8 wherein said exterior portion (21) and said bottom portion (26) obtain a substantially perpendicular relation to each other when said safety device (20) is disposed upon the vertical leg (11) of an L-shaped steel rail (10) of a metal bed frame.

10. The safety device (20) of claim 9 wherein said bottom portion (26) of said configuration is readily disposed in contact with the bottom face (16) of the horizontal leg (12) of an L-shaped steel rail (10) of a metal bed frame when said safety device (20) is disposed upon the vertical leg (11) of said rail (10).

11. The safety device (20) of claim 8 wherein said exterior portion (21) and said bottom portion (26) obtain a relation to each other characterized by an acute angle therebetween when said safety device (20) is disposed upon the vertical leg (11) of an L-shaped steel rail (10) of a metal bed frame.

12. The safety device (20) of claim 11 wherein said bottom portion (26) of said configuration is readily disposed in contact with the bottom face (16) of the horizontal leg (12) of an L-shaped steel rail (10) of a metal bed frame when said safety device (20) is disposed upon the vertical leg (11) of said rail (10).

* * * * *